United States Patent [19]

Sickles

[11] 4,186,886

[45] Feb. 5, 1980

[54] ADAPTING MEANS PROVIDING DETACHABLE MOUNTING OF AN INDUCTION-CHARGING ADAPTER HEAD ON A SPRAY DEVICE

[75] Inventor: James E. Sickles, Glenshaw, Pa.

[73] Assignee: PPG Industries, Inc., Pittsburgh, Pa.

[21] Appl. No.: 931,062

[22] Filed: Aug. 4, 1978

[51] Int. Cl.[2] ..... B05B 5/02

[52] U.S. Cl. ..... 239/691; 239/600; 239/705; 239/707

[58] Field of Search ..... 239/690–708, 239/600; 361/227

[56] References Cited

U.S. PATENT DOCUMENTS

| | | | |
|---|---|---|---|
| 3,613,993 | 10/1971 | Gourdine | 239/705 |
| 3,677,470 | 7/1972 | Probst et al. | 239/707 |
| 3,740,612 | 6/1973 | Gauthier et al. | 239/706 |
| 4,009,829 | 3/1977 | Sickles | 239/705 |

*Primary Examiner*—Robert B. Reeves
*Assistant Examiner*—Michael J. Forman
*Attorney, Agent, or Firm*—Thomas C. Naber

[57] ABSTRACT

An induction-charging adapter head may be quickly and easily mounted on, or demounted from, a conventional spray device equipped with a plate-like adapter of the type disclosed. The plate-like adapter also provides for safe connection or disconnection of a high voltage source to the induction-charging adapter head electrode by providing means for maintaining an electrical path to ground between the adapter head and plate-like adapter during the making or breaking of the high voltage connection.

10 Claims, 8 Drawing Figures

ADAPTING MEANS PROVIDING DETACHABLE MOUNTING OF AN INDUCTION-CHARGING ADAPTER HEAD ON A SPRAY DEVICE

BACKGROUND OF THE INVENTION

1. Field of the Invention

Electrostatic spraying devices which provide spray streams of charged liquid particles by an induction-charging mechanism are well known. Of particular interest herein is an adapting device that provides means for mounting an induction-charging adapter head to a spray device and for quickly and safely disconnecting the adapter head from the spray device.

2. State of the Art

There has been recently provided an improved electrostatic spray device of the induction-charging type as disclosed in U.S. Pat. No. 4,009,829 to J. E. Sickles and in U.S. Patent Application Ser. No. 814,953 filed July 12, 1977 of J. E. Sickles, the disclosures of which are incorporated herein by reference. These induction-charging electrostatic spray devices are characterized in having an induction-charging electrode disposed exteriorly of, or outwardly from, an external-mixing liquid spray-forming nozzle.

Electrostatic induction-charging external-mixing spray devices, especially of the hand-held type, provide significant advantages in safety and in coating deposition efficiency over corona or contact charging spray devices. Corona-discharge spraying systems typically utilize needle-like electrodes that establish corona-producing electric fields by application of potentials of about 100,000 volts to the electrode with resulting corona-discharge currents approximating 50–300 microamps. Such high-power electric discharges present potential shock hazards to equipment operators. Moreover, there is great likelihood in corona systems of high potential electric discharge by arcing from the electrode to a ground point or by sparks from the electrode to air-borne particulate matter, which electric discharges can ignite flammable paint vapors. The hazard of fire and explosion resulting from paint vapors ignited by arcing or sparking produced by corona-discharge equipment has, for example, substantially precluded use by major household appliance manufacturers of electrostatic spray devices for spraying organic-based paints onto the interior surfaces of appliance cabinets.

An induction-charging spray device of the aforementioned type provides, under ideal conditions, practically no likelihood of substantial arcing, sparking, or high energy corona discharges. The absence of any substantial discharge is assured by an electrode surface configuration that is devoid of sharp edges and points and by the application of high voltage potentials to the electrode of about 25,000 volts or less, with normal current dissipation by the electrode being at a level of about 1 to 3 microamps or less. With the induction-charging electrode operating at these substantially lower voltage and current levels as compared to a typical corona-discharge electrode, any incidence of arcing or sparking is substantially reduced. Moreover, operator injury resulting from electric shock is avoided by the practically insignificant current available to be delivered by the electrode.

In addition to the aforementioned improved safety features, the described induction-charging spray device provides improved charged particle atomization. It has been found that a spray device comprising an induction-charging electrode disposed exteriorly of, or outwardly from, an external-mixing nozzle provides an assembly of particles characterized by a high degree of fineness and uniform size and having a relatively high average charge-to-mass ratio. These factors are important in achieving maximum transfer of coating material from the spray device to the target substrate and for achieving levelling or flow of the material into an evenly deposited, uniformly coalesced film.

This unique combination of safety and deposition efficiency features of the described induction-charging spray device is responsible for the significant commercial success of the device in over-coming problems inherent with corona-charging types of electrostatic spray equipment.

Another quite significant advantage of the aforementioned induction-charging systems is that an induction-charging adapter head of the described type is adaptable to many conventional spray devices, both of the electrostatic and non-electrostatic types. Thus a non-electrostatic spray device such as the Binks Model 62 external-mixing, hand-held spray gun (Binks Mfg. Co., Chicago, Ill.) may have attached to its forward barrel portion an induction-charging adapter head of the type disclosed in aforementioned U.S. Pat. No. 4,009,829. This combination of spray-forming means and induction-charging means has proven particularly suitable for many industrial applications where hand-held electrostatic spray devices are used to spray organic based flammable paints in confined spaces.

It has been found, however, that after periods of spraying of pigmented paints or high solids materials in confined spaces, the induction-charging electrode of an induction-charging system may collect significant amounts of coating material. It may then be necessary to detach the induction-charging adapter head from the spray device so that the contaminated adapter head may be soaked in a container of solvent for a period of time to remove the accumulated coating material. A spare adapter head may then be mounted on the spray device so that the spraying operation may continue. It is desirable, in order to minimize the length of equipment down-time, that mounting or demounting of an adapter head onto, or from, a spray device be effected quickly.

It is known that effective particle formation and charging is accomplished by the balancing of several parameters, such as, the velocity of liquid flow, the viscosity and electrical conductivity of the liquid material to be atomized, the velocity of the atomizing air flow, the charging voltage applied to the induction-charging electrode, the radial distance of the induction-charging electrode outwardly from the axis of the spray-forming nozzle, and the axial location of the electrode with respect to the plane of the nozzle discharge ports. A change in any one of these parameters may require some compensating alteration in one or more other parameters. It is highly desirable, therefore, that in the midst of a spraying operation after adjustment of other spraying parameters, the replacement of an induction-charging adapter head be accomplished such that the replacement head-to-spray gun relative position is virtually identical to that of the original head-to-gun position.

Another problem associated with the mounting and demounting of an induction-charging adapter head to and from a spray gun is the possibility of electrical shock to an equipment operator. For example, there may occur a failure in an induction charging system equipment component, such as a power-controlling flow switch failing to interrupt power to the induction charging electrode between spraying cycles. And frequently an equipment operator when removing an adapter head from a spray device will grip or touch the charging electrode. If the ground connection is broken between electrical ground and an induction-charging head of the type having a ground shield, the body of an operator may then form a segment of the path from the ground shield to electrical ground. Contact by the operator with the charged electrode after the ground connection is broken may result in unpleasant electrical shock to the operator.

SUMMARY OF THE INVENTION

Improved adaptability between components of an induction-charging electrostatic spraying system may be provided by adapting means of the invention which allows an induction-charging adapter head to be quickly mounted on, or demounted from, a wide variety of commercial spray devices, with a high degree of safety to spray equipment operators. The induction-charging adapter head may be of the type disclosed in the aforementioned U.S. Pat. No. 4,009,829 having a housing fabricated of a dielectric material. The housing typically has at least one induction-charging electrode attached to an interior wall of the housing. Included on the housing are high voltage contact means connected to the induction-charging electrode. The spray device may be of practically any of the conventional types having a liquid-material spray-forming nozzle.

The adapting means generally comprises a frame fabricated of dielectric material and first securing means on the frame for detachably securing an induction-charging adapter head onto the frame. When the frame is mounted on a spray device, the induction-charging adapter head is preferably detachably mounted on the frame such that an induction-charging electrode of the adapter head is positioned outwardly of the axis of a spray stream provided by the spray-forming nozzle. Also located on the frame of the adapting means are first high voltage contact means for making a detachable electrical connection to high voltage contact means on the induction-charging adapter head, when the adapter head is detachably mounted upon the frame.

One advantage of the described adapting means is the provision of an induction-charging adapter head being quickly and easily attachable to, and detachable from, a spray device. The speed and ease of mounting and demounting of the adapter head is enhanced by the first high voltage contact means of the adapter means frame being capable of making a detachable electrical connection with mating high voltage contact means on the adapter head. During a spraying operation, when there is need to exchange a paint-contaminated induction-charging adapter head with a clean adapter head, an operator may in one step attach or detach the adapter head and make or break the high voltage connection without having to make or break the adapter head-to-spray device mechanical connection and the high voltage connection separately.

The adapting means may be further characterized in having on its frame first ground potential contact means for making a detachable electrical connection to an electrical ground potential contact means on the induction-charging adapter head.

In a preferred embodiment, the adapting means may be further characterized by means for maintaining electrical connection between the first ground potential contact means on the frame and the ground potential contact means on the induction-charging adapter head during the making or breaking of a high voltage connection between the first high voltage contact means on the frame and the high voltage contact means on the adapter head, as the adapter head is mounted on, or demounted from, the frame of the adapting means. The aforementioned structure provides a significant safety feature inasmuch as an electrical path to ground is maintainable at all times while the induction-charging electrode is in electrical connection with a high potential source. Hence, the likelihood of electrical discharges from the electrode through the body of an operator to a ground potential point is substantially eliminated.

The aforementioned safety feature is particularly suitable for an induction-charging circuit having a shunt or bleeder resistor connected between the high voltage contact means of the induction-charging electrode and the ground potential contact means on the induction-charging adapter head, such as disclosed in copending U.S. applications Ser. No. 911,645 filed June 1, 1978 of J. E. Sickles et al and Ser. No. 911,646 filed June 1, 1978 of J. E. Sickles, the disclosures of each which is incorporated herein by reference. The shunt resistor provides a current leakage path to ground for electrical energy stored in the induction-charging electrode circuit. During the breaking of the high voltage connection between the adapter head and the frame of the adapting means, there is a tendency for charge stored in the electrode circuit, or in other portions of the circuit to arc across the gap formed between the high voltage contact means forming the high voltage connection. Maintenance of a current path to ground for a period of time after the high voltage connection is broken provides additional time for charge stored in the adapter head electrode circuit to decrease to a level insufficient to cause hazardous sparking events. The decrease in the amount of charge stored in the capacitive elements of the electrode circuit also decreases the likelihood of fires or explosions that may result from dropping the charged adapter head into a container of flammable solvent.

The frame of the adapting means may be integrally formed with a forward end portion of a gun-like spray device, or the frame may be in a form that is independently securable to the gun-like spray device. In the latter form, the frame may have second securing means for detachably mounting the frame onto a forward end, or downstream portion, of a spray device adjacent the spray-forming nozzle. The frame will then preferably include second high voltage contact means for making a detachable electrical connection to connecting means of a high potential source, such as a shielded cable connected to a high potential output terminal of a power supply.

Also included on the frame will preferably be second ground potential contact means for making a detachable electrical connection to a ground potential contact either attached to, or separate from, the spray device. Typically, a ground potential contact point may be provided by a portion of the metallic barrel of the forward end of the spray device. An electrically conductive path to ground may thus be provided by the metallic sheath of the spray device covering its barrel and handle members and a metal-sheathed hose for delivering coating material or compressed air. Or, a separate grounding wire may be connected from the spray device to an electrical ground potential point shared by the target and the grounded side of the power supply circuit.

Between the first and second high voltage contact means on the frame there is connected an electrical conductor, which may typically be a wire molded into the frame. A similar electrical conductor may be provided within the frame for connecting the first and second ground potential contact means of the adapting means.

These second securing and second electrical contact elements on the frame enhance the adaptability features of the adapting means inasmuch as the frame may be easily detached from one spray device and quickly attached to another spray device in the event the first spray device becomes clogged with paint or is otherwise rendered defective.

Still another advantage of the adapting means of the invention is the adaptability of the frame member to spray devices of various sizes and configurations. For example, the adapting means frame may be characterized in having a ring-shaped frame defining an opening. The frame opening may vary in dimensions and in configuration, that is, it may be circular, ellipsoidal or rectangular in shape to accommodate a forward end portion of a spray device barrel of complementary size and shape.

BRIEF DESCRIPTION OF THE DRAWINGS

In the drawings which form part of a description of an illustrative embodiment of the present invention, and wherein like reference numbers refer to like structural elements.

DETAILED DESCRIPTION

Figure 1:
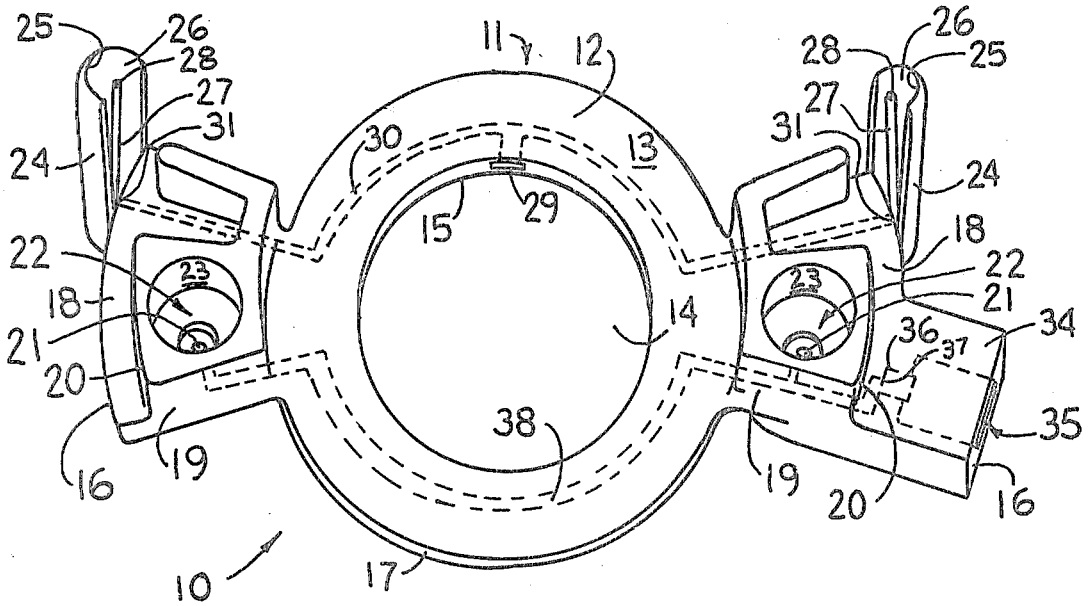
FIG. 1 is a perspective view of one embodiment of adapting means of the invention.

Referring now to the drawings and more particularly FIG. 1, there is illustrated one embodiment of an adapting device of the invention which provides means for quickly attaching and detaching an induction-charging adapter head to and from a spray-forming device. Adapting device 10 comprises a plate-like frame 11 that is mountable upon a spray device. The frame is fabricated of a dielectric material. Suitable dielectric materials are those which can withstand substantial mechanical stresses without fracturing. Also, the frame material must be capable of withstanding electrical stresses imposed by the highest voltages provided to the induction-charging electrode by the power supply without the occurrence of electrical breakdown of the material, such as "surface tracking", that is, current leakage along material surfaces that may occur under conditions of high ambient humidity. An example of a dielectric material found suitable is thermoplastic polyester resin sold under the VALOX® trademark of G.E. Co.

Frame 11 has a mid-portion shaped in the configuration of a ring 12. When adapting device 10 is mounted upon a spray device, a front face 13 of ring 12 is oriented in a downstream direction with respect to the axis of a spray stream formable by the spray device. Ring 12 defines an orifice 14 bounded by an inner wall 15 of ring 12. Orifice 14 has its axis disposed in a generally coaxial relationship with the axis of ring 12, which orifice axis is disposed in a generally perpendicular relationship with the plane of ring front face 13.

There are first securing means included on frame 11 for detachably securing an induction-charging adapter head onto the frame. The first securing means comprises a pair of flanges 16 integrally formed with ring 12, each flange being disposed at opposite portions of outer circumferential edge wall 17 of ring 12. Each of flanges 16 extends outwardly from the axis of ring 12 with its front face 18 substantially parallel to a plane containing ring front face 13. Upon each of the front faces 18 of flanges 16 is a support member 19 extending downstream from the face of flange 16 in a direction generally parallel with the axis of orifice 14. Support member 19 has a curvilinear wall 20 defining a generally convex surface which faces outwardly of the axis of ring 12. As depicted in FIG. 1, each of walls 20 extends in a circumferential direction about ring outer edge wall 17 for a distance of approximately one-tenth the circumference of a circle defined by the convex surfaces of support walls 20. Each of walls 20 has a surface area containing segments of its arc length in the curvilinear direction and by its extent in a downstream direction substantially parallel to the axis of ring 12. Walls 20 provide surfaces for supporting an induction-charging adapter head and thus comprise a portion of the first securing means for detachably securing the adapter head to frame 11.

There are first high voltage electrical potential contact means on frame 11 for making a detachable electrical connection to high voltage contact means of an induction-charging adapter head of a type having two electrodes. The high voltage contact means on frame 11 comprises a pair of high voltage contact elements 21 each of which is characterized by a metallic, female-type receptacle located at the base of a cylindrical cavity 22 within each of support members 19. Each of cylindrical cavities 22 has an axis generally parallel with the axis of ring 12, and each has a dimension in a downstream direction approximately the same as the downstream extent of wall 20. Cylindrical cavities 22 have concave walls 23 which provide additional supporting surfaces for complementary-shaped surfaces of plug-like lugs 69 of an induction-charging adapter head and which serve to guide high voltage contact means on an adapter head into proper connection with the receptacle of high voltage contact elements 21 on frame 11.

The adapting device is further characterized by first electrical ground potential contact means on frame 11. The first ground contact means comprises an arm 24 integrally formed with an outermost edge portion of each of flanges 16. Arm 24, which is fabricated of a dielectric material, extends downstream from front face 18 of flange 16 in a direction generally parallel with the axis of ring 12. Arm 24 projects in the downstream direction to an extent substantially greater than the downstream extent of support member 19. Arm 24 is further characterized in having a longitudinal-shaped channel 25 extending the length of the arm with a longitudinal-shaped mouth 26 of channel 25 facing the axis of ring 12. Located within each of channels 25 is an electrically conductive wire-like ground contact element 27 that extends almost the length of channel 25, but which has a terminus 28 just short of the end of channel 25. Grounding element 27 projects through the plane of the mouth of channel 25 at an acute angle with respect to the plane such that grounding element terminus 28 is positioned outside the confines of channel 25. The grounding element is spring-like in character inasmuch as a moderate force applied at terminus 28 may displace it from its biased position into the confines of the channel.

The adapting device may have second electrical ground potential contact means provided on frame 11 by a metallic tab 29 which protrudes from ring inner wall 15 inwardly toward the axis of ring 12. Ground tab 29 may contact a grounded sheath of a spray gun or may make separate electrical connection to a ground wire. Also, ground tab 29 may protrude from the upstream face of ring 12 which is opposite front face 13. Tab 29 will then preferably have a spring-like bias against a metallic collar portion found on the barrel of some conventional spray devices to ensure a good ground connection when the adapting means is mounted on the spray device. An electrically conductive wire-like element 30, encapsulated within the dielectric material of ring 12, connects each of ground contact elements 27 at the base of arm 24 at ground contact point 31. In one embodiment as depicted in FIG. 1, wire-like element 30 may be in the form of a flat metal strip. Ground contact element 27 may then comprise a length of music wire soldered to the metal strip at contact point 31, the length of music wire having fitted over it a brass or copper tube that provides an increased area of contact with the ground shield.

Figure 7:
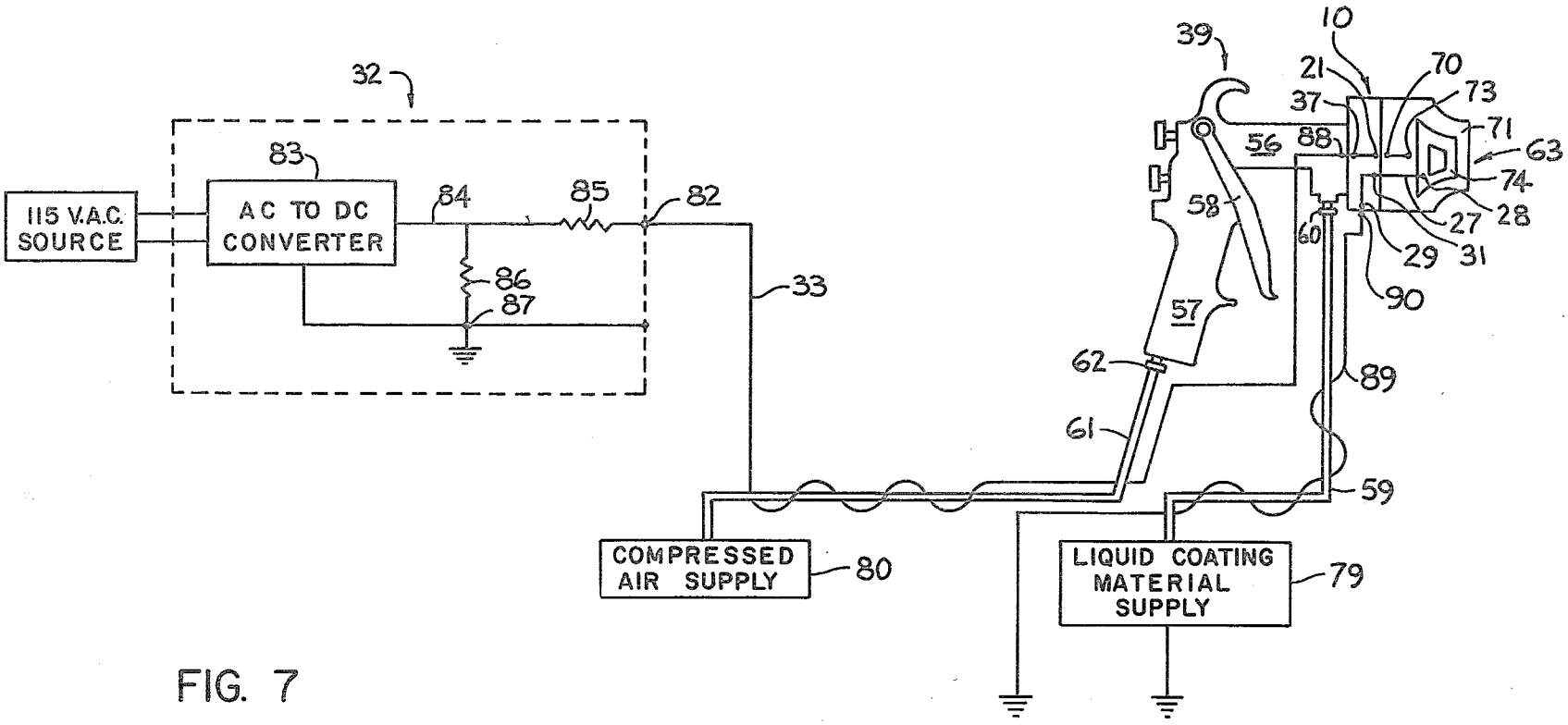
FIG. 7 is a diagrammatic presentation showing elements of a typical induction-charging spraying system.

The adapting device may have second high voltage contact means on frame 11 for making a detachable electrical connection to a high voltage source. In spraying systems having a remotely located power supply 32 such as illustrated in FIG. 7, a high voltage carrying cable 33 may be connected to a terminal of the second high voltage contact means on frame 11. This cable connecting means may comprise a lug 34 integrally formed with frame 11 at an outermost circumferential edge of one of flanges 16. Lug 34 projects outwardly from the axis of ring 12 and has within its body a cylindrically-shaped cavity 35. At the base of cavity 35 is a metallic, female-type receptacle 36 that contains a high voltage contact element 37. An electrically conductive wire-like element 38, encapsulated within the dielectric material of frame 11, connects high voltage contact element 37 with each of high voltage contact elements 21 located within cavities 22.

An induction-charging spraying system may utilize a portable power supply mounted on a barrel of a spray device, such as those disclosed in U.S. Application Ser. No. 739,170 filed Nov. 5, 1976, now U.S. Pat. No. 4,120,017, issued Oct. 10, 1978 of J. E. Sickles and Ser. No. 739,171 filed Nov. 5, 1976, now U.S. Pat. No. 4,120,016, issued Oct. 10, 1978 of C. D. Hendricks. In such a system, a suitable mating connection between the power supply and high voltage contact element 37 may be made in a manner similar to that of the aforementioned ground connection of grounding tab 29 and the metallic sheath of a spray device.

Figure 2:
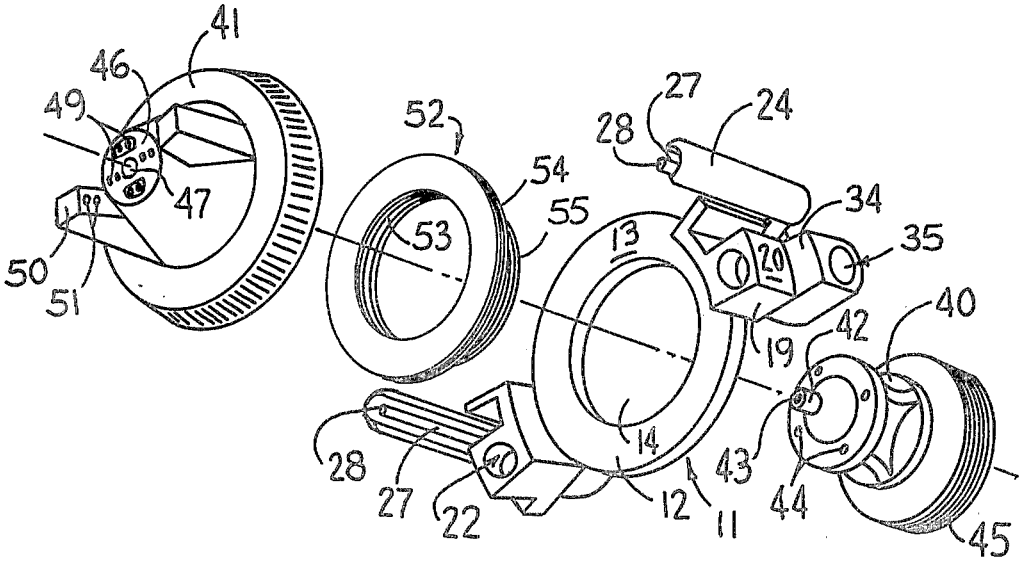
FIG. 2 is an exploded assembly view illustrating in perspective parts of a nozzle assembly in their relative location with respect to the adapting means of FIG. 1.
Figure 3:
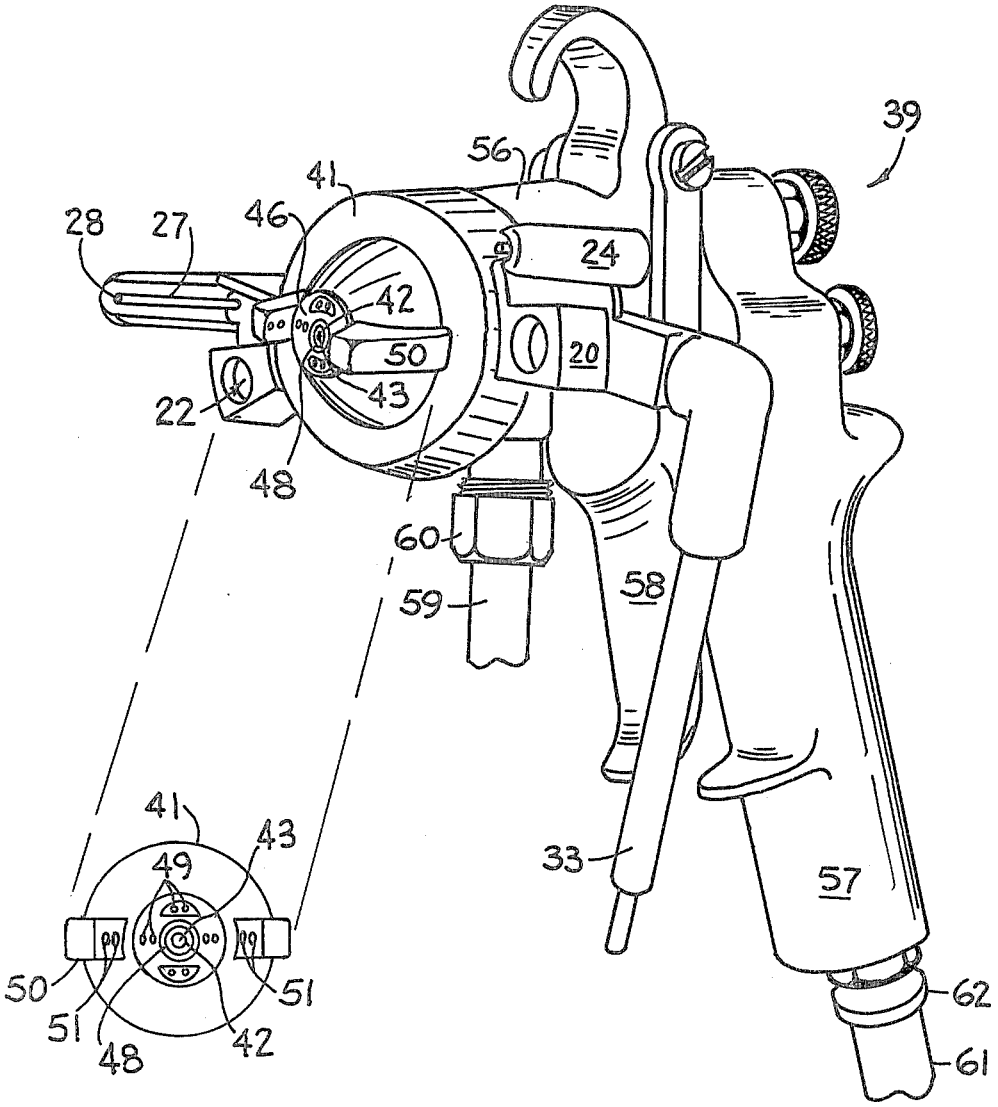
FIG. 3 is a perspective view of a conventional spray device having mounted on its forward or downstream-oriented end the adapting means of FIG. 1 together with the nozzle assembly of FIG. 2.

Referring to FIGS. 2 and 3, adapting device 10 is depicted in relation to a gun-like spray device 39 and spray nozzle elements. The nozzle elements comprise a liquid nozzle body 40 and an air cap 41. At a downstream end of nozzle body 40 is a liquid nozzle extension 42 disposed generally along the axis of nozzle body 40. An axially located liquid-conveying passageway (not shown) within nozzle body extension 42 terminates at liquid discharge port 43. Air conveying passageways (not shown) within nozzle body 40 terminate at air discharge ports 44. Threads 45 provide means for operatively engaging nozzle body 40 to a forward end portion of spray device 39 having corresponding liquid- and air-conveying passageways.

Air cap 41 has a downstream-oriented face 46 through which passes an axially located orifice 47 having a diameter somewhat greater than the outer diameter of liquid nozzle extension 42. An assembly of air cap 41 and liquid nozzle 40 provides an atomizing-air discharge port 48 having an annulus configuration as defined by the positioning of liquid nozzle extension 42 within orifice 47. Atomizing-air discharge port 48 is thus disposed in a generally concentric relationship with respect to liquid discharge port 43. Streams of liquid coating material and atomizing air discharged from ports 43 and 48, respectively, coact to form a spray stream of particles that is discharged generally coaxially with respect to the liquid nozzle axis and in a downstream direction with respect to air cap face 46. Also located on air cap face 46 are additional air discharge ports 49. Projecting downstream from air cap face 46 and integrally formed with air cap 41 is a pair of air horns 50. Located on air horns 50 on faces oriented toward the spray stream axis are additional air discharge ports 51. Air discharge ports 49 and 51 cooperate to shape the spray stream into a fan configuration. Air for discharge from the described air discharge ports may be supplied from a plenum (not shown) established by the assembly of air cap 41 and nozzle body 40.

Adapting device 10 may be secured to a spray device by a press or sleeve fit between inner wall 15 of frame ring 12 and a complementary-shaped surface of a barrel portion of a spray device. More typically, however, adapting device 10 may be secured to a spray device 39 as depicted in FIGS. 2 and 3. In the exploded assembly view of FIG. 2, there are illustrated means for securing adapting device 10 to nozzle elements of spray device 39. A ring-like adapter collar 52 has an inner threaded wall portion 53 and an outer threaded wall portion 54. Integrally formed with collar 52 at its upstream-oriented face is an annular-shaped shoulder that has an outer diameter of a dimension sowewhat less than the inner diameter of frame ring 12.

Nozzle body 40, air cap 41 and adapter collar 52 cooperate as an assembly attached to a forward end portion of spray device 39 to provide means for securing adapting device 10 to spray device 39. Threads 45 on nozzle body 40 mate with complementary-threaded portions on the interior of the forward or downstream end of spray gun barrel 56. Adapter collar shoulder 55 provides a supporting surface for the complementary-fitting inner wall 15 of frame ring 12. Collar 52 and nozzle body 40 cooperate to position frame 11 on spray device 39 so that frame front face 13 is oriented in a downstream direction. Threaded portions on an inner wall of air cap 41 mate with outer wall threaded portion 54 of adapter collar 52 and also with outer wall threaded portion 45 of nozzle body 40 to secure the assembly of adapter collar 52 and adapting device 10 onto spray gun barrel 56.

Adapter collar 52 is shown with inner wall 53 defining an opening having a configuration and size complementary to the cross-sectional configuration of cylindrically-shaped spray gun elements. Collar 52 may well have any interior configuration to be adaptable to a variety of sizes and shapes of the nozzle end portions of practically any conventional spray device.

Spray device 39 is a commercially available hand-held gun of the air-atomizing siphon type (Model 62, Binks Mfg. Co., Chicago, Ill.) Adjacent handle 57 is a trigger 58 which serves to operate a valve assembly (not shown) within barrel 56 to regulate flows of liquid coating material and an atomizing gas, such as air, to the nozzle elements. A liquid coating material, such as a paint having a conductivity generally greater than 0.001 umho/cm, is fed to the spray device from a paint supply through a paint feed hose 59 which is connected to spray device 39 by mating threaded members on barrel 56 and hose 59 forming connecting means 60. From a compressed air supply air feed hose 61 delivers atomizing air under pressure to connecting means 62 at the base of handle 57 which comprises an assembly of mating threaded members.

Figure 4:
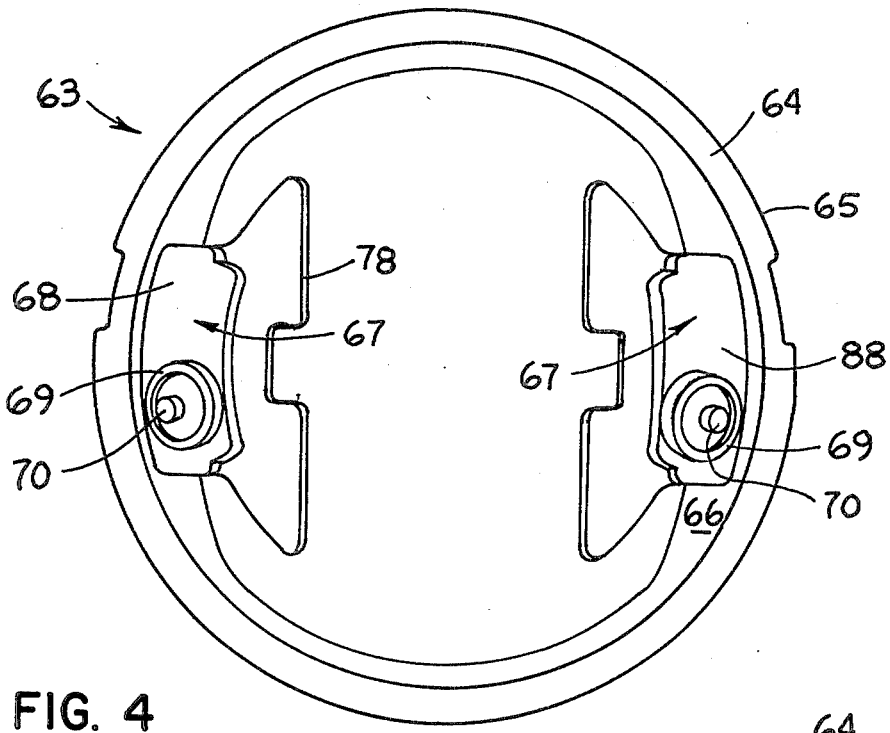
FIG. 4 is a rear elevation view of an induction-charging adapter head with a view downstream into the adapter head.
Figure 5:
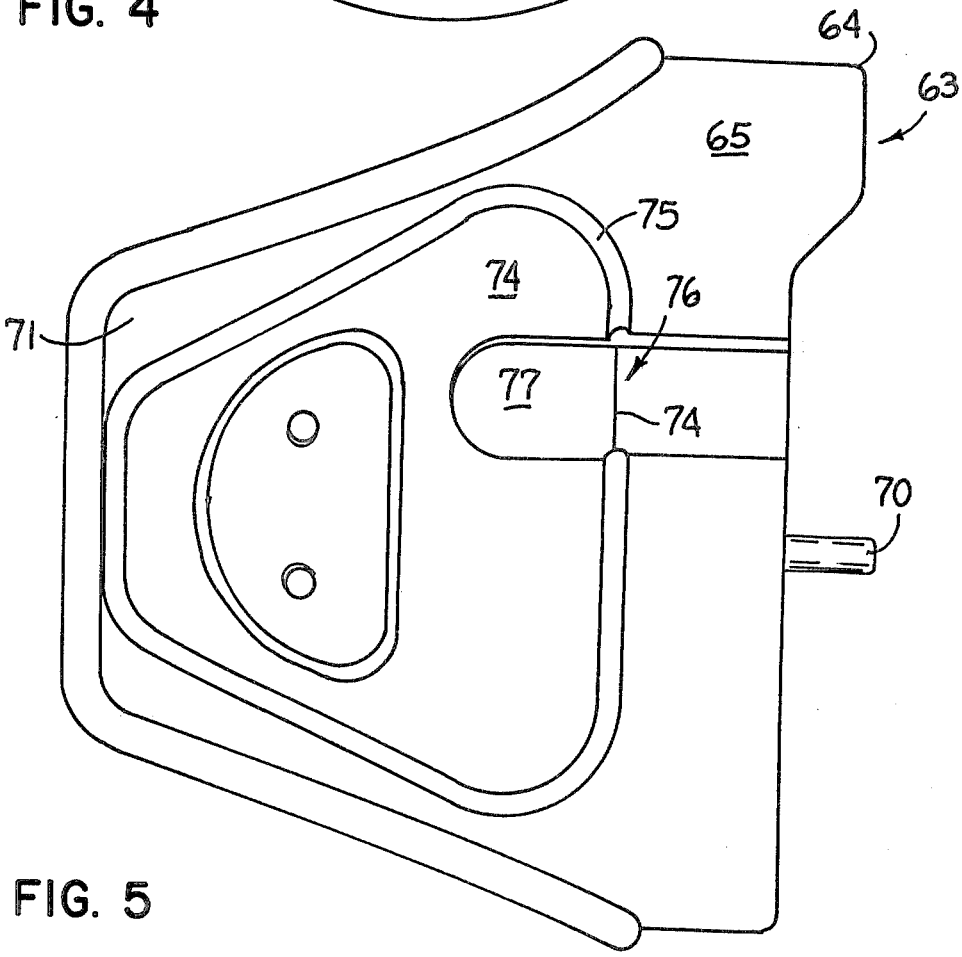
FIG. 5 is a side elevation view of the induction-charging adapter head of FIG. 4.

Depicted in FIGS. 4 and 5 is an induction-charging adapter head 63 of a type suitable for mounting on the adapting device 10 fitted to spray gun 39. The adapter head comprises a housing 64 fabricated of a dielectric material. The dielectric material should be capable of withstanding stresses associated with the high voltages provided by the power supply without electrical breakdown or tracking. Useful dielectric materials include those set forth above for fabricating adapting device frame 11. Housing 64 is of cylindrical shape having an outer wall 65 and an inner wall 66 in a generally concentric relationship with respect to the axis of housing 64. Mounted upon oppositely disposed portions of housing inner wall 66 is a pair of electrode support members 67, also fabricated of the described types of dielectric material. Support member 67 has an upstream-facing wall 68 from which a cylindrically-shaped lug 69 projects in the upstream direction. Lug 69 is fabricated of dielectric material and is integrally formed with electrode support member 67. At the upstream end of each of lugs 69, there projects a metallic, male-type high voltage terminal 70 suitable for making electrical connection with its counterpart mating terminal provided by high voltage contact element 21 located in the base of cavity 22 of adapting device 10.

Housing 64 is characterized in having wall portions extending in a downstream direction to form a pair of lobes 71. An induction-charging electrode 72 is mounted upon each of electrode support members 67. Portions of electrodes 72 extend downstream for a distance generally coincident with the downstream extent of lobes 71. Electrical connection within support member 67 between terminal 70 and electrode 72 is provided by connecting circuit element 73.

The induction-charging adapter head 63 preferably has a pair of ground shield electrodes 74, each comprising a metallic foil or sheet secured to the exterior wall of lobe 71. The shield electrodes generally conform in shape to the shape of lobes 71, each having a surface area approximating the area of induction-charging electrode 72. A bead 75 of dielectric material runs around the periphery of shield electrode 74. The purpose of the bead is to minimize the incidence of corona discharge from the ground shield electrode edges, should there be an intense electric field established at the periphery of the shield electrodes. Further description of these shield electrodes and their purposes may be found in U.S. Pat. No. 4,009,829 to J. E. Sickles, the disclosure of which is incorporated herein by reference.

Along the rearward or upstream-oriented edge of each of shield electrodes 74, there is a gap 76 in dielectric bead 70. A channel-like depression 77 in shield electrode 74 extends from this gap to a point near the mid-portion of the shield electrode.

Figure 6:
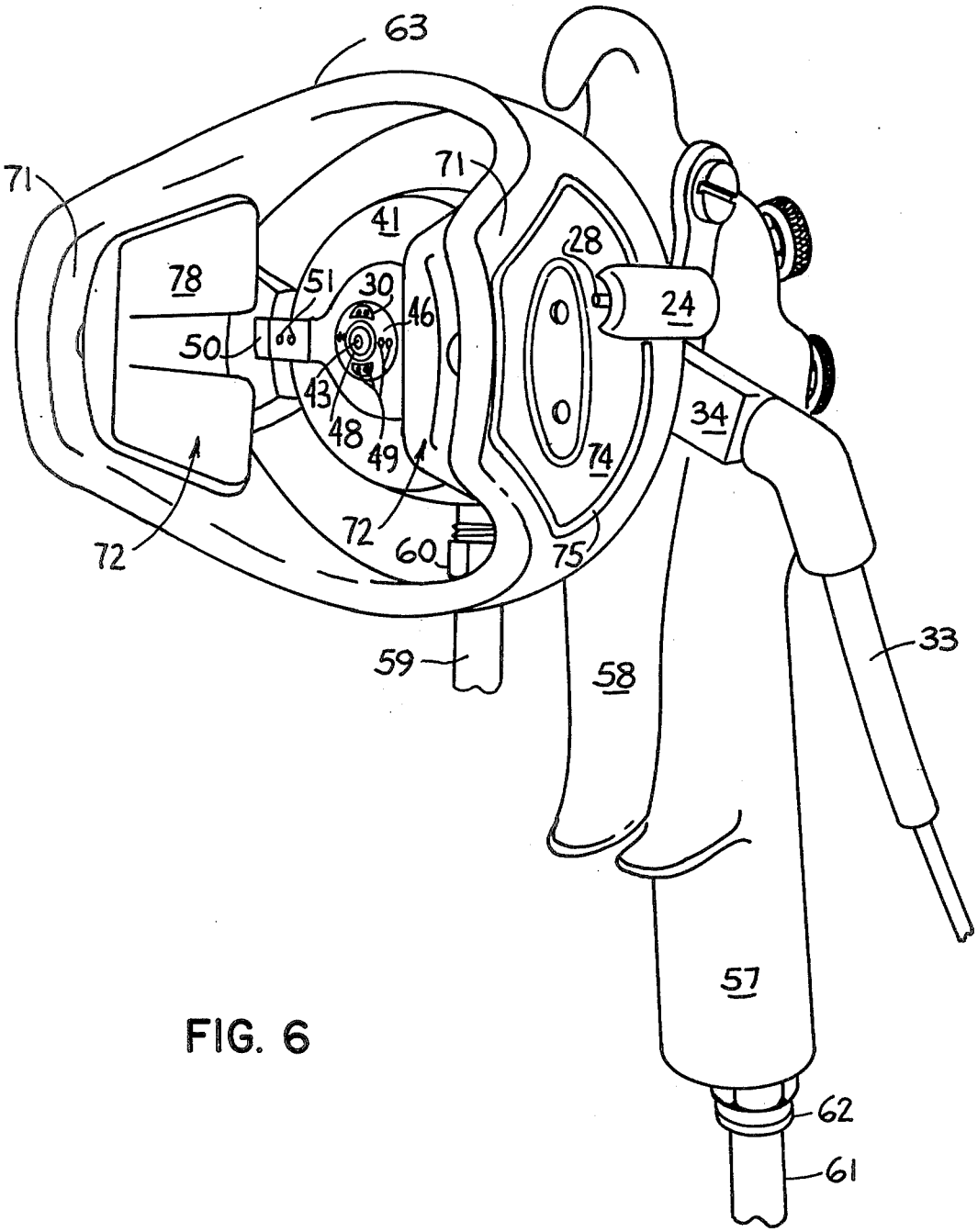
FIG. 6 is a perspective view of the spray device of FIG. 3 having mounted thereon the adapting means of FIG. 1, together with the nozzle assembly of FIG. 2 and the induction-charging adapter head of FIG. 4.

An induction-charging adapter head 63 is mountable upon a spray device 39 fitted with an adapting device of the invention, as shown in FIG. 6. The adapter head 63 is supported on the adapting device 10 by a friction fit between rearward or upstream portions of housing inner wall 66 and complementary-shaped surfaces of support walls 20 on frame 11. The rigid interconnections formed between each of lugs 69 and a mating cavity 22 provides additional support for adapter head 63, as well as providing circumferential orientation of the adapter head with respect to the spray device nozzle elements. As illustrated in FIG. 6, adapter head 63 is mounted upon spray device 39 such that induction-charging electrodes 72 are positioned exteriorly of, or radially outwardly from, the external-mixing nozzle assembly. Preferably, electrodes 72 are positioned with respect to the nozzle assembly so that at least a portion of the surface of electrode wall 78 from which the induction-charging field is established intersects a plane containing liquid discharge port 43. Thus, with respect to a plane containing air cap face 46, the electrode wall surface intersects the plane, with at least a portion of the wall surface extending downstream from, or forwardly of, air cap face 46. The radial distance of electrodes 72 outwardly from the axis of liquid discharge port 43 will generally determine the magnitude of the voltage required to be applied to electrodes 72 to provide an induction-charging field. For the apparatus illustrated in FIG. 6 having each electrode wall 78 spaced outwardly about $\frac{3}{4}$ inch from the liquid discharge nozzle axis, DC voltages between about 5,000 volts to about 25,000 volts will produce an effective induction-charging field in a region surrounding liquid discharge port 43, which field has an average potential gradient in the range from about 7 kilovolts per inch to about 33 kilovolts per inch. Voltages that are so high as to cause corona discharge from electrodes 72 during normal operation are to be avoided. In this respect, the induction-charging electrode 72 may be characterized as one which is substantially non-corona producing, that is, electrode 72 has a configuration which is substantially free of sharp angles, points, or surface discontinuities that may tend to produce corona discharges in the aforementioned voltage range.

In an induction-charging device such as that utilized in the present invention, liquid coating material atomization and electric charge imposition occur substantially simultaneously so as to create a stream of discrete particles bearing an induced electric charge. For example, the stream of liquid coating material which passes through liquid discharge port 43 of the nozzle assembly is thrust into contact with a flow of air or gas from concentrically disposed atomizing-air discharge port 48, which flow of gas or air impinges upon and mixes with the liquid stream and tends to distort the stream into an irregular configuration comprising surface discontinuities. Formation of cusp-like, liquid stream discontinuities or "liquid termini" is aided by the high intensity electric field existing between high voltage electrode 72 and the grounded liquid stream. The electric field flux lines tend to concentrate at the sharp-pointed liquid termini and to induce electric charge redistribution within the liquid stream, with charge of sign opposite that of the high voltage electrode migrating to the extreme sharp portions of the liquid termini. Since the charges on the liquid termini and on the electrode are opposite in sign, electrical attractive forces cooperate with the mechanical distresses furnished by the flow of gas or air to separate the liquid termini from the liquid stream so as to form discrete coating material particles bearing electric charge.

The described embodiment of the adapting means of the invention is particularly suitable for use in an induction-charging system of a type diagrammatically illustrated in FIG. 7. Hand-held gun-like spray device 39 receives coating material from an electrically grounded liquid coating material supply 79 through paint feed hose 59. Compressed air is delivered from air supply 80 through air feed hose 61 for atomizing the liquid material into a spray stream and for shaping the stream into a fan configuration by means of the aforementioned nozzle elements. Mounted at the forward or downstream end of barrel 56 of spray gun 39 is adapting means 10 of the invention represented schematically in block form. Attached to adapting means 10 is induction-charging adapter head 63 of the described type, also shown in block form. A remotely located power supply 32 adjustably provides output voltages ranging from 5,000 to 25,000 volts DC to high voltage shielded cable 33 connected at cable connecting terminal 82. Within power supply 32 a converter 83 provides at high potential terminal 84 a high potential DC output of the required range from a 115 volt AC source. A description of an AC to DC converter suitable for an induction-charging system of the invention is found in the aforementioned U.S. Pat. No. 4,073,002 to J. E. Sickles et al, the descriptions of the power supply and converter components of which are incorporated herein by reference. The power supply may also have a current limiting resistor 85 in series between the high voltage output terminal 84 and cable connecting terminal 82. There may be in addition a shunt or bleed resistor 86 between high voltage output terminal 84 and an electrical ground point 87 within the power supply. The values and purposes of these resistors are fully discussed in the aforementioned U.S. Pat. No. 4,073,002.

The first and second high voltage contact means and the first and second ground contact means of the adapting means are shown schematically in a charging circuit for the induction-charging system represented diagrammatically in FIG. 7. High voltage cable 33 has a terminus 88 connectable to a mating high voltage contact element 37 comprising the second high voltage contact means of adapting means 10 which, in turn, is connected to high voltage contact element 21 comprising the first high voltage contact means. A ground wire 89 has a terminus 90 connectable to the second ground contact means which may comprise metallic tab 29 on the adapting device 10. The first ground contact means of the adapting device is schematically represented as comprising wire element 27 connected at its base on adapting means 10 at ground contact point 31. With induction-charging adapter head 63 mounted upon adapting device 10, contact element 21 of the first high voltage contact means connects with terminal 70 on the adapter head to complete a high voltage path to the induction-charging electrodes through circuit element 73. Ground contact element 27 completes a ground path to ground shield electrode 74 through contact made by ground contact wire terminus 28 with the channel-like depression of ground shield electrode 74.

The aforementioned advantages of the adapting means of the invention are made apparent with reference to the embodiment depicted in the drawings. As depicted in FIG. 3, adapting device 10, when secured to spray gun 39 by the described nozzle elements, provides rigid support for induction-charging adapter head 63. Replacement adapter heads may be attached to and detached from frame 11 with relative ease. The support member walls 20 and cavities 22 on the frame cooperate, respectively, with housing inner wall 66 and lugs 69 of the adapter head to provide a rigid support for, and proper orientation of, the induction-charging head with respect to the spray-forming nozzle. One-step, rapid and positive connection of and disconnection both of the high voltage and ground contact means is provided by the described connecting means comprising, respectively, high voltage contacts 21 and 70 and ground contacts 27 and 77.

The grounding contact between frame 11 and induction-charging adapter head 63 is depicted in FIG. 6. When the adapter head is mounted upon the frame, arm 24 passes through gap 76 of bead 75 of dielectric material such that terminus 28 of grounding element 27 makes contact with ground shield electrode 74 in channel-like depression 77. The spring-like character of grounding contact element 27, which biases the element to a position outside of the confines of channel 25, ensures positive contact with a portion of shield electrode depression 77.

Figure 8:
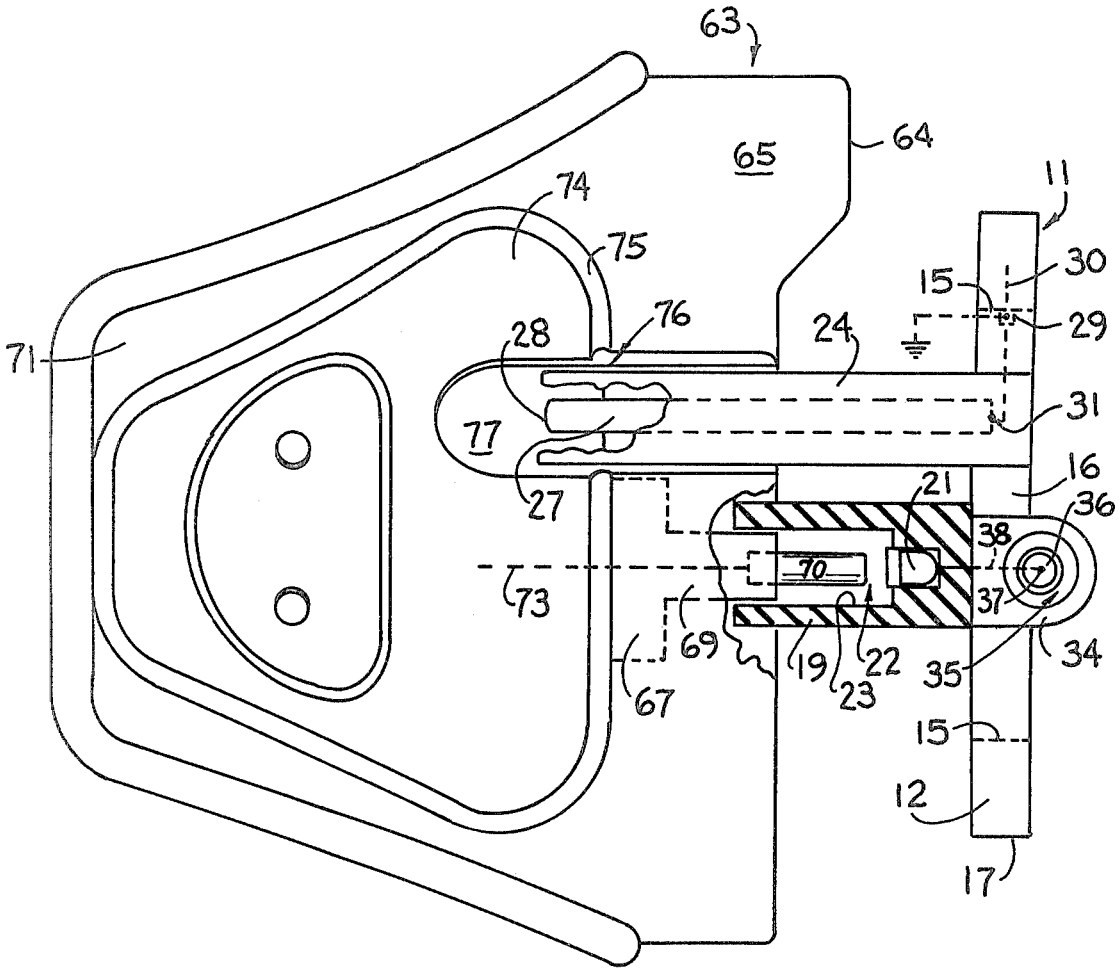
FIG. 8 is a side elevation view of an assembly of the induction charging adapter head of FIGS. 4 and 5 mounted upon the adapting device of FIG. 1.

There is depicted in FIG. 8 induction-charging adapter head 63 in a partially mounted (or partially demounted) position with respect to frame 11 of adapting means 10. As can be seen from the illustrated portions in section, a portion of lug 69 of adapter head 63 protrudes into mating contact with a portion of cavity 22 on frame 11. High voltage terminal 70 extends from lug 69 into cavity 22 but is shown not making contact with high voltage contact element 21 within the receptacle of cavity 22. At the same time, there remains an electrically conductive path from shield electrode 74 to ground through the connection provided by grounding element 27 where its terminus 28 contacts a portion of channel-like depression 77. Because the ground connection is made before the making of the high voltage connection and is broken after the breaking of the high voltage connection, there is virtually always a ground path provided from shield electrode 74 to a ground point on frame 11 when a high voltage is applied to induction-charging electrode 72.

From the foregoing description, one skilled in the art can easily ascertain the essential characteristics of the invention, and without departing from the spirit and scope thereof, can make various changes and modifications to adapt it to various usages and conditions.

What is claimed is:

1. Adapting means for providing detachable mounting of an electrostatic induction charging adapter head onto a spray device, the adapter head comprising a housing fabricated of dielectric material, the housing having attached thereto at least one induction charging electrode and high voltage contact means connected to the induction charging electrode, the spray including a spray-forming nozzle having an axis generally parallel with the axis of a stream of spray particles formed by the nozzle, said adapter means comprising:

(a) a plate-like frame comprised of dielectric material;

(b) first securing means included on said plate-like frame for detachably securing said induction charging adapter head onto said frame, so that said induction charging electrode of the adapter head is disposed outwardly of a spray-forming nozzle, when said frame is mounted on said spray device and when the induction charging adapter head is detachably mounted on said frame; and (c) first high voltage contact means on said plate-like frame for making a detachable electrical connection to high voltage contact means on the induction charging adapter head.

2. The adapting means of claim 1 further characterized in having on said plate-like frame first ground potential contact means for making a detachable electrical connection to ground potential contact means on the induction charging adapter head.

3. The adapting means of claim 2 further characterized by means for maintaining electrical connection between said first ground potential contact means on said plate-like frame and the ground potential contact means on the induction charging adapter head during the making or breaking of a high voltage connection between said first high voltage contact means on said frame and the high voltage contact means on the adapter head, as the adapter head is mounted on or demounted from said frame.

4. The adapting means of claim 3 wherein said first securing means for detachably mounting said induction-charging adapter head upon said plate-like frame further comprises a pair of support members, each of said support members attached at generally opposite edge portions about the axis of said plate-like frame and extending outwardly from one face of said plate-like frame in a direction generally parallel with the axis of said plate-like frame, said support member having a curvilinear wall facing outwardly of the axis of said plate-like frame, each of said curvilinear walls being spaced relative to the other wall and having a curvature appropriate to receive in frictional contact complementary shaped and disposed mating walls of said induction-charging adapter head.

5. The adapting means of claim 4 wherein said first securing means for detachably mounting said induction-charging adapter head upon said plate-like frame further comprises a cylindrically shaped cavity within each of said support members, the axis of each of said cylindrical cavities being generally parallel to the axis of said plate-like frame, each of said cavities appropriate to receive in frictional contact a plug-like mating projection on said induction-charging head.

6. The adapting means of claim 5 further comprising a metallic contact element within each of said cavities, said metallic contact element providing said first high voltage contact means for making a detachable electrical connection to high voltage contact means on the induction-charging adapter head.

7. The adapting means of claim 6 further comprising a pair of elongated channeled members formed of dielectric material, each of said channeled members extending axially outwardly from said plate-like frame, and disposed adjacent one of said support members, open channel portions of said channeled members being in generally facing relationship;

each of said channeled members further characterized in having an electrically conductive member within the open channel portion of said channeled members, said conductive member providing said first ground potential contact means;

each of said channeled and conductive members further characterized in having an extent in an axial direction substantially greater than the axial extent of an electrically conductive path provided by mating contact of said first high voltage contact means contained with said cylindrical cavities and high voltage contact means of the induction-charging adapter head;

whereby ground potential contact between said conductor of said channeled member and ground contact means on the induction-charging adapter head is maintained during the making or breaking of electrical contact between said first high voltage contact means on said plate-like frame and the high voltage contact means of the induction-charging adapter head, as the induction charging adapter head is mounted on, or demounted from, said plate-like frame.

8. The adapting means of claim 2 further characterized by (a) second securing means included on said plate-like frame for detachably mounting said frame onto said spray device;

(b) second high voltage contact means on said frame for making a detachable electrical connection to high potential source connecting means;

(c) second ground potential contact means on said frame for making a detachable electrical connection to ground potential contact means;

(d) electrical conductor means on said frame for connecting together said first and second high voltage contact means; and (e) electrical conductor means on said frame for connecting together said first and second electrical ground potential contact means.

9. The adapting means of claim 8 wherein said second securing means for detachably mounting said plate-like frame to said spray device comprises a collar defining an orifice lying in the plane of said frame, said orifice disposed about the geometric center of said frame, said geometric center lying on an axis coaxial with the path of a spray stream discharged by the spray device when said frame is detachably mounted on the spray device, said orifice having a diameter of a size for receiving a spray device barrel portion of complementary fitting size and shape to said orifice, said frame securable on the barrel portion of cooperation of said collar with a retainer member securing the spray nozzle to the barrel portion.

10. The adapting means of claim 9 further characterized by said first securing means and said second securing means disposed in spaced relationship on said plate-like frame so that when the induction-charging adapter head is mounted on the spray device the induction-charging electrode is disposed radially outwardly of the spray nozzle, with at least a portion of the electrode intersecting a plane perpendicular to the axis of the spray nozzle, which plane contains the liquid discharge port of the spray nozzle.

* * * * *

UNITED STATES PATENT AND TRADEMARK OFFICE

CERTIFICATE OF CORRECTION

PATENT NO. : 4,186,886

DATED : February 5, 1980

INVENTOR(S) : James E. Sickles

It is certified that error appears in the above-identified patent and that said Letters Patent are hereby corrected as shown below:

Column 13, line 11, insert --device-- after "spray".

Column 14, line 63, "of" (first occurrence) should be --by--.

Signed and Sealed this

*Twenty-seventh* Day of *May 1980*

[SEAL]

*Attest:*

SIDNEY A. DIAMOND

*Attesting Officer*

*Commissioner of Patents and Trademarks*